US008302410B2

(12) United States Patent
Yuan et al.

(10) Patent No.: US 8,302,410 B2
(45) Date of Patent: Nov. 6, 2012

(54) INERTANCE TUBE AND SURGE VOLUME FOR PULSE TUBE REFRIGERATOR

(75) Inventors: Sidney W. Yuan, Los Angeles, CA (US); Carl S. Kirkconnell, Huntington Beach, CA (US); Kenneth D. Price, Long Beach, CA (US); Anthony T. Finch, Long Beach, CA (US); Gerald R. Pruitt, San Pedro, CA (US)

(73) Assignee: Raytheon Company, Waltham, MA (US)

( * ) Notice: Subject to any disclaimer, the term of this patent is extended or adjusted under 35 U.S.C. 154(b) by 1014 days.

(21) Appl. No.: 11/981,184

(22) Filed: Oct. 31, 2007
(Under 37 CFR 1.47)

(65) Prior Publication Data

US 2009/0107150 A1 Apr. 30, 2009

(51) Int. Cl.
*F25B 9/00* (2006.01)

(52) U.S. Cl. ..... 62/55.5

(58) Field of Classification Search ..... 62/6, 55.5; 60/517, 520
See application file for complete search history.

(56) References Cited

U.S. PATENT DOCUMENTS

| | | | | |
|---|---|---|---|---|
| 5,966,943 | A | 10/1999 | Mitchell | |
| 2004/0045315 | A1 * | 3/2004 | Kamoshita et al. | 62/615 |
| 2007/0044484 | A1 * | 3/2007 | Gedeon | 62/6 |

FOREIGN PATENT DOCUMENTS

| | | | |
|---|---|---|---|
| JP | 03 001542 | B1 | 1/2000 |
| JP | 2001 141320 | A | 5/2001 |
| JP | 2001 304708 | A | 10/2001 |
| JP | 2002 106992 | A | 4/2002 |
| JP | 2005 307015 | A | 2/2005 |
| WO | 2007024314 | A2 | 3/2007 |

OTHER PUBLICATIONS

International Search Report/Written Opinion dated Dec. 10, 2008 of PCT/US2008/081597 filed Oct. 29, 2008 (12 pages).

* cited by examiner

*Primary Examiner* — Melvin Jones

(57) ABSTRACT

An inertance tube and a surge volume for a pulse tube refrigerator system may be integrally coupled together, such as by the inertance tube being at least in part a channel in a wall of the surge volume. The surge volume may have a helical channel in an outer wall that forms part of the inertance tube. The surge volume tank may be surrounded by a cover that closes off the channel to form the inertance tube as an integral part of the surge volume. The inertance tube may have a non-circular cross section shape, such as a square shape or non-square rectangular shape. The channel may be tapered, perhaps changing aspect ratio. Alternatively, the inertance tube may be a separate tube having a non-circular shape, which may be wrapped around at least part of the surge volume.

18 Claims, 3 Drawing Sheets

INERTANCE TUBE AND SURGE VOLUME FOR PULSE TUBE REFRIGERATOR

BACKGROUND OF THE INVENTION

1. Field of the Invention

The invention is in the general field of cryocoolers and refrigeration systems, and in particular relates to cryocoolers and refrigeration systems that include pulse tubes.

2. Description of the Related Art

Good performance of pulse tube coolers has been achieved by use of small diameter flow lines, known as inertance tubes, as phase shifters to maximize cooling efficiency. Such phase shifting inertance tubes have had considerable length, for example 1-4 meters, that makes packing them in a compact system difficult. Also, the considerable length of phase shifting inertance tubes can lead to difficulties due to vibration and possible mechanical failure of the tubes. Accordingly, it will be appreciated that improvements in pulse tube systems with phase shifting inertance tubes are possible.

SUMMARY OF THE INVENTION

According to an aspect of an embodiment of the invention, an inertance tube for a pulse tube system has a non-circular cross-section.

According to another aspect of an embodiment of the invention, an inertance tube is integrated with a surge volume, with the wall of the surge volume forming at least part of the boundaries of the inertance tube.

According to yet another aspect of an embodiment of the invention, a surge volume has a channel in a cylindrical wall that forms part of the boundary of an inertance tube.

According to another aspect of an embodiment of the invention, a refrigeration system includes: a pulse tube; a surge volume; and an inertance tube in fluid communication with the surge volume and an outlet of the pulse tube. The inertance tube has a non-circular cross section.

According to still another aspect of an embodiment of the invention, a refrigeration system includes: a pulse tube; a surge volume; and an inertance tube in fluid communication with the surge volume and an outlet of the pulse tube. At least part of the inertance tube is a channel between a wall of the surge volume and a cover surrounding the surge volume.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

An inertance tube and a surge volume for a pulse tube refrigerator system may be integrally coupled together, such as by the inertance tube being at least in part a channel in a wall of the surge volume. The surge volume may have a helical channel in an outer wall that forms part of the inertance tube. The surge volume tank may be surrounded by a cover that closes off the channel to form the inertance tube as an integral part of the surge volume. The inertance tube may have a non-circular cross section shape, such as a square shape or non-square rectangular shape. The channel may be tapered, perhaps changing aspect ratio. Alternatively, the inertance tube may be stepped, having one or more abrupt changes of cross-sectional area and/or shape along its length. Alternatively, the inertance tube may be a separate tube having a non-circular cross section shape, which may be wrapped around at least part of the surge volume. The integration of the inertance tube and the surge volume may reduce size and/or weight of the combined system. In addition, the use of a noncircular inertance tube may reduce the length requirement of the inertance tube needed to achieve the desired phase shift, and/or may improve efficiencies in the pulse tube refrigeration system.

Figure 1:
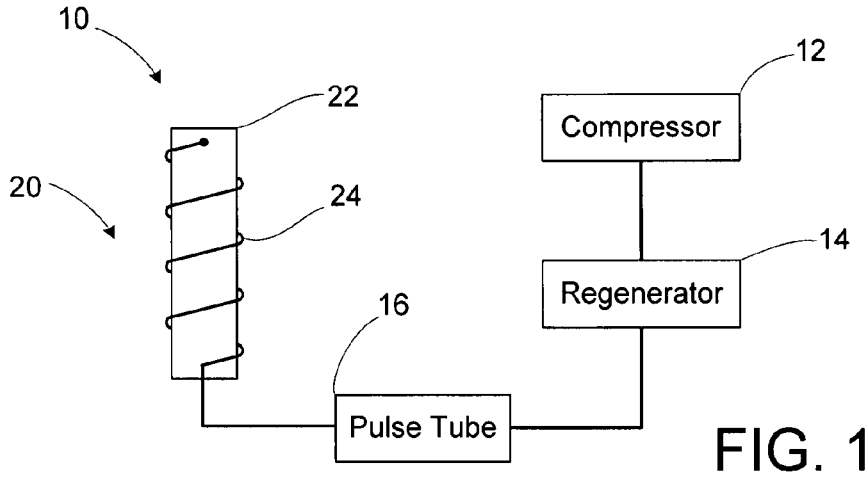
FIG. 1 is a schematic diagram of a cryocooler or refrigeration system in accordance with an embodiment of the present invention.

FIG. 1 schematically illustrates a pulse tube refrigeration or cryocooler system 10. The system 10 includes a compressor 12, a regenerator 14, and a pulse tube 16. Downstream of the pulse tube 16, a combined inertance and surge volume unit 20 includes a surge volume 22 and an inertance tube 24. The inertance tube 24 may perform a phase shifting function within the system 10. The surge volume 22 and the inertance tube 24 may be integrated together in a single device, for example by having the inertance tube 24 as part of or surrounding the surge volume 22. Alternatively or in addition, the inertance tube 24 may have a non-circular cross section, as described in greater detail below.

Figure 2:
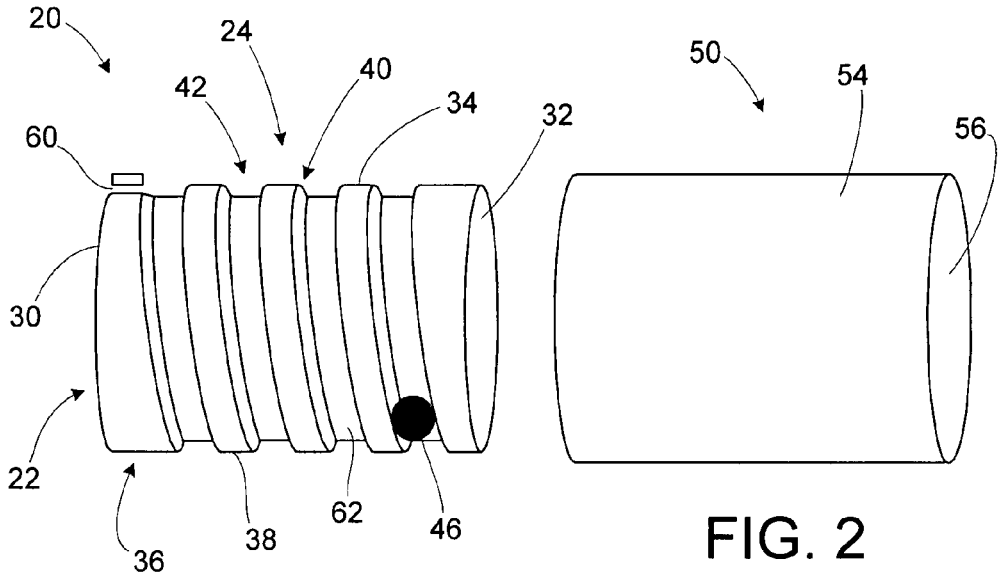
FIG. 2 is an exploded view of one embodiment of a combined inertance and surge volume unit for use with the cryocooler of FIG. 1.
Figure 3:
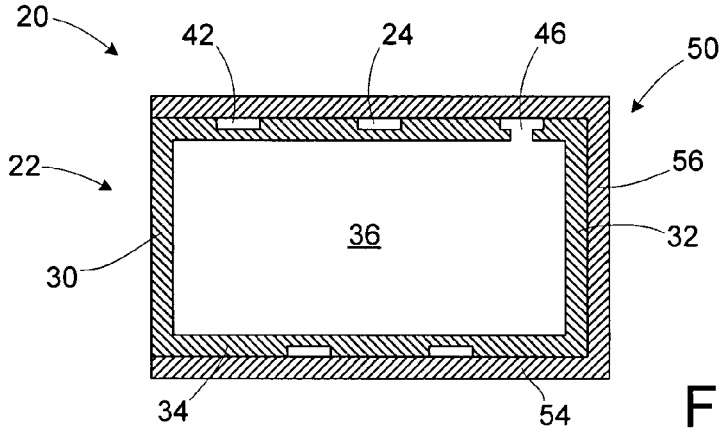
FIG. 3 is a cross-sectional view of the unit of FIG. 2.

FIGS. 2 and 3 show one embodiment of the combined inertance and surge volume unit 20, in which the surge volume 22 and the inertance tube 24 are integral parts of a single device. The surge volume 22 is a cylindrical tank having a pair of circular end walls 30 and 32, and a substantially cylindrical side wall 34. The end walls 30 and 32 and the side wall 34 together enclose a working gas enclosed volume 36. The enclosed volume 36 contains a working gas of the cryocooler system 10. The enclosed volume 36 is in fluid communication with other parts of the cryocooler system 10.

An outer surface 38 of the side wall 34 has a helical groove 40 formed therein. The helical groove 40 defines a channel 42 that serves as part of the inertance tube 24. The helical groove 40 in essence forms an open channel 42 that defines much of the inertance tube 24. The channel 42 in the illustrated device has a rectangular cross section shape, having a pair of substantially right angles. It will be appreciated that this is only one of many shapes possible for the channel 42; other alternative shapes are described below.

The channel 42 is in fluid communication with the inner enclosed volume 36 via a hole 46. The hole 46 serves as the inertance tube outlet and is located at one end of the helical groove 40, close to the end wall 32. The hole 46 is a hole all the way through the material of the cylindrical side wall 34.

A hollow cylindrical cover 50 fits over the end wall 32 and the cylindrical side walls 34 of the surge volume 22. The cover 50 slides over the surge volume 22 from the bottom end, the end of the surge volume 22 having the end wall 32. The cover 50 provides a close fit with the cylindrical side wall 34 and seals outer ends of the channel 42. The channel 42 is thus transformed into a closed channel that functions as a single spiral or helical channel about the outside of the surge volume 22. The cover 50 includes a cylindrical portion 54 and an end cap 56. The cylindrical portion 54 provides a close fit to the outer surface 38 of the cylindrical side wall 34 of the surge volume 22. The cylindrical portion 54 radially surrounds the surge volume 22.

The helical groove 40 may have an extension 60 that functions as an inertance tube inlet. The inertance tube inlet 60 is at a top end of the surge volume 22, located close to the end wall 30. The extension for the inertance tube inlet 60 is in communication with the remainder of the helical groove 40.

The surge volume 22 and the cover 50 together define the inertance tube 24, located within the side wall 34 of the surge volume 22. Flow from an outlet of the pulse tube 16 is directed toward the inertance tube inlet 60. The channel 42 which defines the shape of the inertance tube 24 wraps around the outside of the cylindrical side wall 34, enclosing the volume 36. Flow is in communication with the inner volume 36 via the inertance tube outlet hole 46.

The arrangement shown in FIGS. 2 and 3 provides many advantages over prior inertance tube designs. By making the inertance tube 24 the integrally-formed channel 42 in the cylindrical side wall 34, good thermal communication is provided between the inertance tube 24 and the surge volume 22. It will be appreciated that a flat bottom surface 62 of the channel 42 provides better heat transfer between the working fluid and the cylindrical side wall 34 then does a circular surface. References herein to a "flat surface" are meant to refer to surfaces that are not curved within the plane of a cross-section of a tube. Surfaces may still satisfy the definition of "flat" even though they are curved along the length of the tube, such as along the length of the helical inertance tube 24.

Integrating the inertance tube 24 with the surge volume 22 also allows for more efficient use of volume. Further, the square cross-section of the channel 42 of the inertance tube 24 has less flow resistance than would a corresponding circular tube having a diameter that is the same as the length of the side of the square channel. Thus flow resistance is reduced without increasing the overall footprint of the inertance tube 24.

Another advantage is that the integrated inertance tube 24 is more structurally robust than unsupported inertance tubes. The inertance tube 24 may be better able than prior art devices to resist shock and vibration. As with all inertance tubes, the inertance tube 24 has the advantage of accomplishing phase shifting while avoiding the need for moving parts. It will be appreciated that moving parts undesirably introduce heat into a system, and raise the possibility of seizing. Both of these are especially unwelcome in cryocooler systems.

The surge volume 22 and the cover 50 may be made of any of a variety of suitable materials. An example of a suitable material is aluminum, such as aluminum alloy 6061-T651.

In an example embodiment the free volume 36 is 238 cc, and the inertance tube 24 is 3.0 meters long with a square cross-section of 2.54 mm×2.54 mm. It will be appreciated that these values are only examples, and that there may be a wide variety of other values for these dimensions.

The surge volume 22 and the cylindrical cover 50 may be assembled by thermally fitting the two parts together, such that the radial interface provides an adequate sealing of the channel 42. Electron beam welding may be used to permanently attach the two parts 22 and 50 together. This electron beam welding may be applied to close an interface gap between the cover 50 and the surge volume 22.

The helical groove 40 may be performed any of a variety of suitable processes. Examples of suitable processes include etching, such as photo etching and laser etching, and machining.

Many variations are possible with regard to the embodiment shown in FIGS. 2 and 3. For example, the inertance tube 24 may have a different cross-sectional shape. The shape may be circular or another non-circular shape. Some alternative non-circular shapes are described below. Suitable channels may be formed in both the cylindrical wall 34 and the cover 50, in order to produce these alternative channel shapes or inertance tube cross sectional shapes.

As another alternative, the inertance may be integrated into the surge volume 22 at other locations, for example being formed as a channel along an inner surface of the cylindrical wall 34 of the surge volume 22.

As another alternative, it will be appreciated that an inner surface of the cylindrical portion 54 of the cover 50 may have a channel machined or etched in it, for use as part of the boundary of the inertance tube 24.

Figure 4:
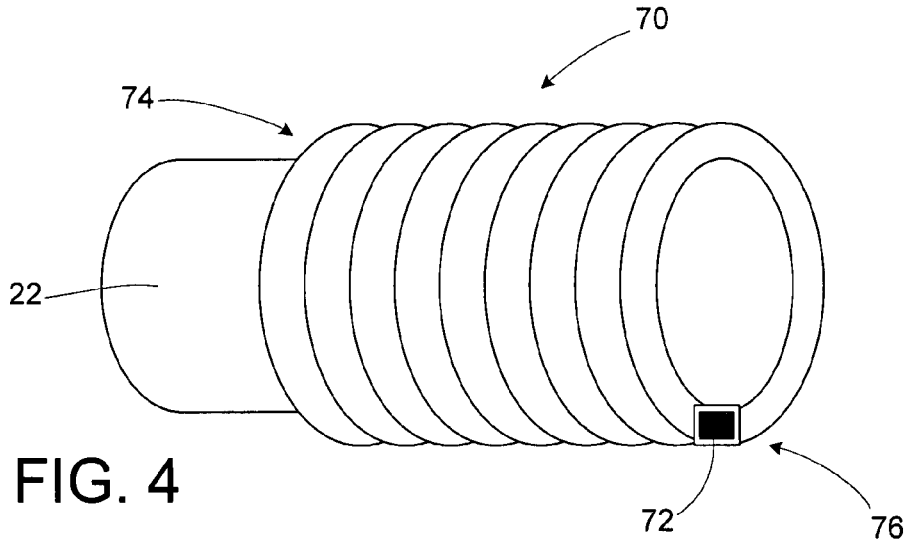
FIG. 4 is an oblique view of another embodiment of a combined inertance and surge volume unit usable with the cryocooler of FIG. 1.

FIG. 4 shows another embodiment of the combined inertance and surge volume unit 20, an embodiment that utilizes a separate piece of tubing 70 as the inertance tube 24. The tubing 70 has a non-circular cross-sectional flow area 72. In the illustrated embodiment, the flow area is square. However, it will be appreciated that the tubing 70 alternatively may have a non-circular cross section of a different shape. The tubing 70 is shown in FIG. 4 has having a spiral shape, and is shown as being wrapped around the surge volume 22. However, other configurations are possible for the tubing 70 having a non-circular cross-sectional flow area. That is, the tubing 70 need not be wrapped around the surge volume 22, and need not have a spiral shape.

The tubing 70 has an inlet end 74 that is in communication with and coupled to the pulse tube 16 (FIG. 1). The tubing 70 also has an outlet end 76 in fluid communication with the surge volume 22.

It will be appreciated that the embodiment shown in FIG. 4 obtains many of the advantages mentioned above with regard to the embodiment shown in FIGS. 2 and 3. The non-circular cross-sectional area of the tubing 70 produces a lower flow resistance then that of circular cross section tubing having a diameter the same as that of a width of the tubing 70. Also, the flat side surface of the square cross-section tubing 70 allows better heat transfer to the surge volume 22, compared with circular cross-sectional tubing.

The tubing 70 may be made of any of a variety of suitable materials. An example of a suitable material is aluminum or an aluminum alloy.

FIGS. 5-9 show various non-circular cross section shapes suitable for either of the inertance tube 24 embodiments described above (either the channel inertance tube shown in FIGS. 2 and 3, or the separate tubing inertance tube shown in FIG. 4).

Figure 5:
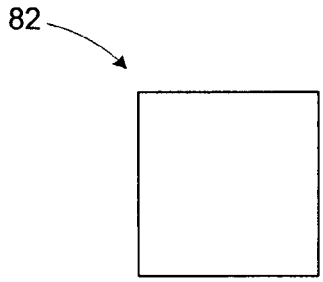
FIG. 5 illustrates a square cross-sectional shape of inertance tube usable in an embodiment of the present invention.
Figure 6:
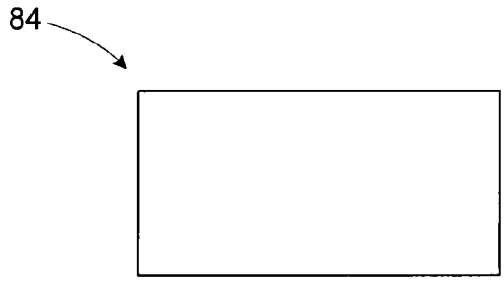
FIG. 6 illustrates a non-square rectangular cross-sectional shape usable in another embodiment of the present invention.
Figure 7:
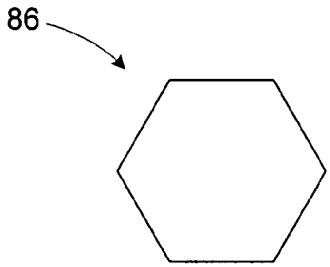
FIG. 7 illustrates a non-rectangular polygonal shape usable in yet another embodiment inertance tube of the present invention.

FIG. 5 shows a square cross-section shape 82. FIG. 6 shows a non-square rectangular cross section 84. The rectangular cross section shape 84 may have any of a wide variety of different aspect ratios (the ratio of height to width). FIG. 7 shows a polygonal cross section shape 86. The particular polygonal cross-section shape 86 shown in FIG. 7 is a hexagonal shape. However, it will be appreciated that a wide variety of the other polygonal shapes are possible. The polygonal shapes need not necessarily be symmetric, and different sides of the shapes may have different lengths.

Figure 8:
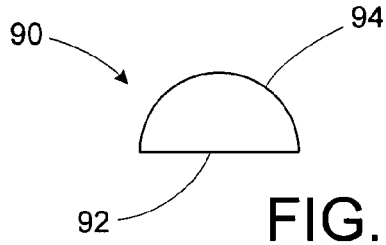
FIG. 8 illustrates yet another cross-sectional shape for an inertance tube, utilizing both flat and curved surfaces.

FIG. 8 shows a cross section shape 90 that combines a flat surface 92 and a curved surface 94, producing a "D" shape. The flat surface 92 may be located along or toward the surge volume 22 (FIGS. 2-4). Alternatively the flat surface 92 may be located away from or distal relative to the surge volume 22. It will be appreciated that a large variety of shapes combing flat surfaces and curved surfaces may alternatively be employed. Cross section shapes utilizing both flat portions and curved portions may utilize any of a variety of suitable orientations and ordering of various numbers of curved and straight portions.

Figure 9:
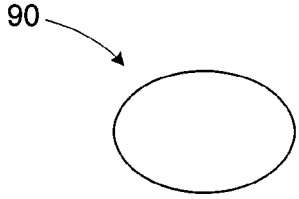
FIG. 9 illustrates still another inertance tube cross-sectional shape, a non-circular curved cross-sectional shape.

FIG. 9 shows an example of a non-circular curved cross section shape 96. The shape 96 is an ellipse, but it will be appreciated that a large variety of suitable curved shapes, and combinations of different curved shapes, may be utilized for the inertance tube 24.

Figure 10:
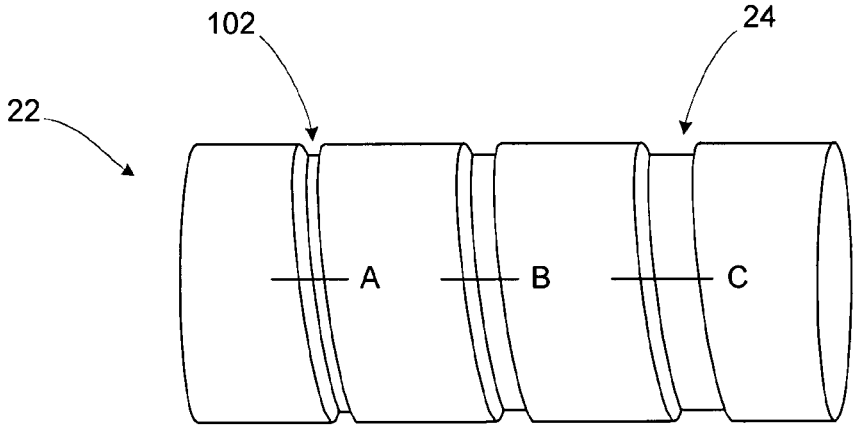
FIG. 10 is an oblique view of a surge volume usable with the cryocooler of FIG. 1, the surge volume having a non-uniform channel.

FIG. 10 shows an alternate embodiment of the surge volume 22, having a non-uniform channel 102. The non-uniform channel 102 produces (in conjunction with the cover 50, shown in FIGS. 2 and 3) a non-uniform cross section inertance tube 24. The non-uniform channel 102 changes in cross-sectional area and/or shape either continuously or in discrete steps along all or part of its length. The non-uniformity is configured so as to reduce flow resistance as flow proceeds along the inertance tube 24 from inlet to outlet.

Figure 11:
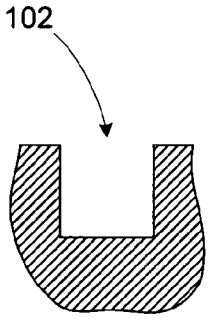
FIG. 11 illustrates a cross-sectional channel in inertance tube shape at a first location along the channel shown in FIG. 10.
Figure 12:
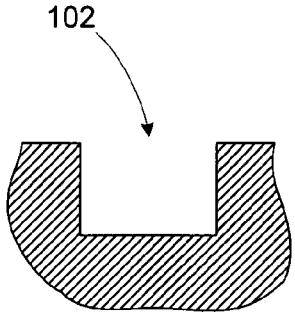
FIG. 12 illustrates a cross-sectional channel in inertance tube shape at a second location along the channel shown in FIG. 10.
Figure 13:
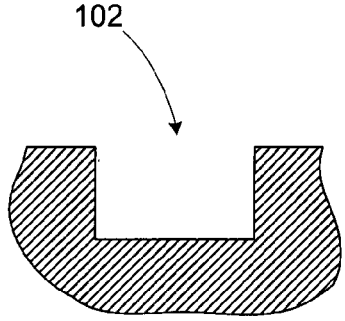
FIG. 13 illustrates a cross-sectional channel in inertance tube shape at a third location along the channel shown in FIG. 10.

One way of accomplishing this reduction in flow resistance is to increase the width of the rectangular channel 102. FIGS. 11-13 illustrate the cross-sectional area of the non-uniform inertance tube 24 at three locations, indicated in FIG. 10 as A, B, C. FIG. 11 shows the square shape of the channel 102 location A, closest to the inlet of the non-uniform inertance tube 24. FIG. 12 shows the rectangular shape at location B, downstream of location A, where the channel 102 has become wider. FIG. 13 shows the cross section at location C, with the channel 102 and the inertance tube 24 widening even further. This increases flow area and correspondently reduces flow resistance. The change in width of the channel 102 may be accomplished by tapering the channel 102, gradually widening it over all or part of the length of the channel 102. Alternatively, the channel 102 may be widened in discrete steps. It will be appreciated that the tapering may result improved performance, but that use of discrete steps may facilitate manufacture.

It will be appreciated that many other configurations are possible for reducing flow resistance along the length of inertance tube 24. For example the shape of the inertance tube 24 may be maintained the same, but the size may be increased either gradually or in discrete steps, to reduce flow resistance. As another alternative, the overall size may be maintained the same, while changing only the shape to reduce flow resistance. For example, gradual or stepwise changes from a circular to a square cross-sectional shape may be made.

The inertance tube and surge volume units described herein may be utilized in a wide variety of pulse tube cryocooler or refrigeration systems. Such systems include multi-stage pulse tube coolers, and hybrid coolers that include pulse tubes, such as Stirling and pulse tube hybrid system.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A refrigeration system comprising: a pulse tube; a surge volume;

and an inertance tube in fluid communication with the surge volume through an outlet of the inertance tube and in fluid communication with an outlet of the pulse tube through an inlet of the inertance tube; wherein the inertance tube has a non-circular cross section and a continuously increasing cross-sectional flow area along an entire length of the inertance tube as fluid flow progresses from the inlet of the inertance tube to the outlet of the inertance tube, said increasing cross-sectional flow area reducing a flow resistance as flow proceeds along the inertance tube from the inlet of the inertance tube to the outlet of the inertance tube.

2. The system of claim 1, wherein the non-circular cross section has at least one flat surface.

3. The system of claim 1, wherein the non-circular cross section is polygonal.

4. The system of claim 1, wherein the non-circular cross section is rectangular.

5. The system of claim 1, wherein the inertance tube changes cross-sectional shape along a length of the inertance tube.

6. The system of claim 5, wherein the non-circular cross section is rectangular, with an aspect ratio that changes along the length.

7. The system of claim 5, wherein the inertance tube is tapered.

8. A refrigeration system comprising: a pulse tube; a surge volume;

and an inertance tube in fluid communication with the surge volume through an outlet of the inertance tube and in fluid communication with an outlet of the pulse tube through an inlet of the inertance tube; wherein the inertance tube has a non-circular cross section and a stepped, discontinuously increasing cross-sectional flow area along an entire length of the inertance tube as fluid flow progresses from the inlet of the inertance tube to the outlet of the inertance tube, said increasing cross-sectional flow area reducing a flow resistance as flow proceeds along the inertance tube from the inlet of the inertance tube to the outlet of the inertance tube.

9. The system of claim 1, wherein at least part of the inertance tube is a channel in a surge volume wall.

10. The system of claim 1, wherein the inertance tube is a piece of tubing.

11. The system of claim 10, wherein the tubing is wrapped around surge volume.

12. A refrigeration system comprising: a pulse tube; a surge volume;

and an inertance tube in fluid communication with the surge volume through an outlet of the inertance tube and in fluid communication with an outlet of the pulse tube through an inlet of the inertance tube; wherein at least part of the inertance tube is a channel between a wall of the surge volume and a cover surrounding the surge volume and the inertance tube has a continuously increasing cross-sectional flow area along an entire length of the inertance tube as fluid flow progresses from the inlet of the inertance tube to the outlet of the inertance tube, said increasing cross-sectional flow area reducing a flow resistance as flow proceeds along the inertance tube from the inlet of the inertance tube to the outlet of the inertance tube.

13. The system of claim 12, wherein the channel is a helical channel in a cylindrical side wall of the surge volume.

14. The system of claim 13, wherein the channel is a rectangular channel.

15. The system of claim 14, wherein the inertance tube has variable cross sectional area, with a greater cross sectional area at an inertance tube outlet than at an inertance tube inlet.

16. The system of claim 13, wherein the side wall has a hole therethrough that functions as an inertance tube outlet, providing fluid communication between the inertance tube and an enclosed volume of the surge volume.

17. The system of claim 12, wherein the inertance tube has a non-circular cross section.

18. The system of claim 12, wherein the channel has a flat bottom surface.

* * * * *

UNITED STATES PATENT AND TRADEMARK OFFICE

CERTIFICATE OF CORRECTION

PATENT NO. : 8,302,410 B2
APPLICATION NO. : 11/981184
DATED : November 6, 2012
INVENTOR(S) : Yuan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1178 days.

Signed and Sealed this
Twenty-sixth Day of August, 2014

Michelle K. Lee

Michelle K. Lee
*Deputy Director of the United States Patent and Trademark Office*